United States Patent [19]

Kero et al.

[11] Patent Number: 4,697,529

[45] **Date of Patent: * Oct. 6, 1987**

[54] PALLET AND METHOD OF MANUFACTURING THE SAME

[75] Inventors: Ernst Kero; Erik Gustafsson, both of Luleå, Sweden

[73] Assignee: Plannja AB, Luleå, Sweden

[ * ] Notice: The portion of the term of this patent subsequent to Apr. 1, 2000 has been disclaimed.

[21] Appl. No.: 867,607

[22] PCT Filed: Feb. 13, 1984

[86] PCT No.: PCT/SE84/00050

§ 371 Date: Oct. 4, 1984

§ 102(e) Date: Oct. 4, 1984

[87] PCT Pub. No.: WO84/03267

PCT Pub. Date: Aug. 30, 1984

Related U.S. Application Data

[63] Continuation of Ser. No. 662,408, Oct. 4, 1984, abandoned.

[30] Foreign Application Priority Data

Feb. 15, 1983 [SE] Sweden ..... 8300822
Jan. 19, 1984 [SE] Sweden ..... 8400252

[51] Int. Cl.[4] ..... B65D 19/28
[52] U.S. Cl. ..... 108/511; 108/51.3
[58] Field of Search ..... 108/51.1, 51.3, 52.1, 108/53.3, 53.5, 55.1, 56.1, 57.1; 206/386, 595, 596, 598

[56] References Cited

U.S. PATENT DOCUMENTS

| | | | |
|---|---|---|---|
| D. 283,267 | 4/1986 | Kero et al. | D34/38 |
| 1,202,046 | 10/1916 | Freeze | 108/51.1 X |
| 1,508,898 | 9/1924 | Smith | 108/51.1 |
| 2,758,776 | 8/1956 | Ellstrom | 108/55.1 X |
| 3,149,586 | 9/1964 | Kemp, Jr. et al. | 108/57.1 |
| 3,602,157 | 8/1971 | Cohen | 108/51.1 |
| 3,626,860 | 12/1971 | Blatt | 108/51.3 |
| 3,911,834 | 10/1975 | Quaintance | 108/51.3 |
| 3,968,895 | 7/1976 | Barnes, Jr. et al. | 206/596 X |
| 4,220,100 | 9/1980 | Palomo et al. | 108/51.1 |

*Primary Examiner*—Kenneth J. Dorner
*Assistant Examiner*—Peter R. Brown
*Attorney, Agent, or Firm*—Holman & Stern

[57] ABSTRACT

The present invention refers to a pallet and a method for manufacturing said pallet. The pallet is made of sheet metal, preferably a one-piece sheet metal blank, said pallet comprising a load-carrying plane (2;2';2'') provided with reinforcing grooves (*7a,7b,8;7'a,7'b,8';7''a*) and lateral pieces (3,4) provided with recesses (5) or openings (6), so arranged that the pallet is accessible from all sides for lifting means inserted beneath the load carrying plane (2;2';2'').

Significant for the pallet according to the invention is that almost all material in the blank is used. This is expecially brought out when the material sections moved aside, by folding, from the main planes of the lateral pieces (3,4), to create recesses (5) or openings (6), are comprised in box beams (40,41,48;40',41',48') reinforcing the pallet.

10 Claims, 22 Drawing Figures

Figure 2:
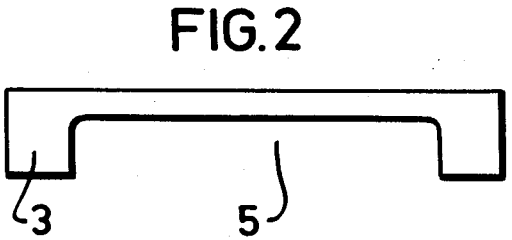

31
29
36

41
27
29
40
7a
28
33
34
35
39

22
30
40
33
7b
21
29
31
31c
30
41
28
23
39
24
48

41
22
21
31b
7b
29
31
31b
7a
27
40
35
34
33

40
29
7a
23
24
42
2
48

PALLET AND METHOD OF MANUFACTURING THE SAME

This is a continuation of application Ser. No. 662,408, filed Oct. 4, 1984, now abandoned.

This invention relates to a pallet assembled of one or several thin sheet metal blanks and comprising a load-carrying plane provided with reinforcing grooves and at least two lateral pieces provided with recesses or openings so arranged that the pallet is accessible from all sides for lifting means inserted beneath the pallet. The method also relates to a method of manufacturing a pallet.

A very great number of the pallets used today are made of wood. These wooden pallets have several shortcomings. They are insanitary, easily damaged, have a relatively high weight and are in spite of low initial cost uneconomic, due to short service life.

A study of known art shows that many attempts have been made to produce a pallet made of metal, which satisfactorily can replace the wooden pallet. Such a pallet, however, cannot be found in the patent literature, and to our knowledge such a pallet is not commercially available, either.

There are several reasons why known pallets of sheet metal could not compete with wooden pallets. The metal pallets, for example, usually were not suitable for massproduction. A usual disadvantage, moreover, of known sheet metal pallets has been their insufficient strength, rigidity and/or elasticity.

It is generally known that pallets normally are subjected to rough treatment. It was found that known pallets of sheet metal do not quite withstand this treatment, but have a tendency to buckle or be deformed by said treatment.

One imaginable reason why known pallets made of sheet metal blanks do not maintain their shape satisfactorily should be, that they do not comprise reinforcing edge box beams in connection to all lateral edges of the load-carrying plane. The reinforcing beams of known pallets, preferably made of one-piece sheet metal blanks, usually have V- or U-shaped cross-section. which means they are not designed as box beams. They are, furthermore, not formed by folding material sections from the sheet metal blank, but bent outward of the same.

A further disadvantage of known pallets is the accessibility from all sides for lifting means. Some of these sheet metal pallets are accessible only from two opposed sides which, of course, is an obvious shortcoming from a handling point of view.

When the sheet metal pallets are accessible for lifting means from all sides, however, certain structural concessions had to be made. At one known pallet of sheet metal the depth of the reinforcing grooves in the plane of the pallet in the area of engagement of the lifting forks has been reduced. This reduction in height of the reinforcing grooves implies a decrease in their reinforcing effect.

At another known sheet metal pallet certain portions of the reinforcing grooves have been removed in order to provide space for the lifting means. The remaining groove portions are suitably interconnected, for example by stay members or the like.

The present invention has the object to produce a pallet of the kind referred to above in the introductory portion, which pallet is reinforced in a satisfactory way in respect of both the load-carrying plane and the lateral pieces.

An optimum reinforcing configuration also permits the use of a relatively small material thickness, preferably 1–1.5 mm, which, of course, contributes in that the pallet according to the present invention is economically of interest.

A further object of the invention is to produce a pallet, which is accessible for lifting means from all sides, and this accessibility is realized without reducing the load-carrying capacity to an unacceptable level.

Still another object of the present invention is to utilize to optimum degree the one-piece sheet metal blank, of which the pallet is manufactured, i.e. to make use of the greater part of the material of the sheet metal blank which is folded aside in connection with the formation of the openings or recesses. This is effected in that said material folded aside is comprised in box beams, which reinforce both the load-carrying plane and the lateral pieces, and in that the circumference for the openings or recesses for the lifting means is reinforced.

An additional object of the present invention is to produce a pallet, the outer dimensions of which agree with the standardization rules applying to a so-called "Europa pallet". It also should be pointed out in this connection, that pallets according to the invention pass the standard load tests for the "Europa pallet".

The pallet according to the present invention is realized by the characterizing features defined in the attached claims.

Figure 3:
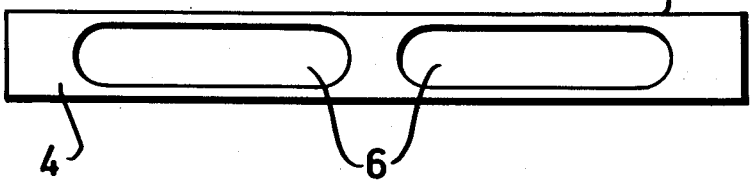
Figure 1:
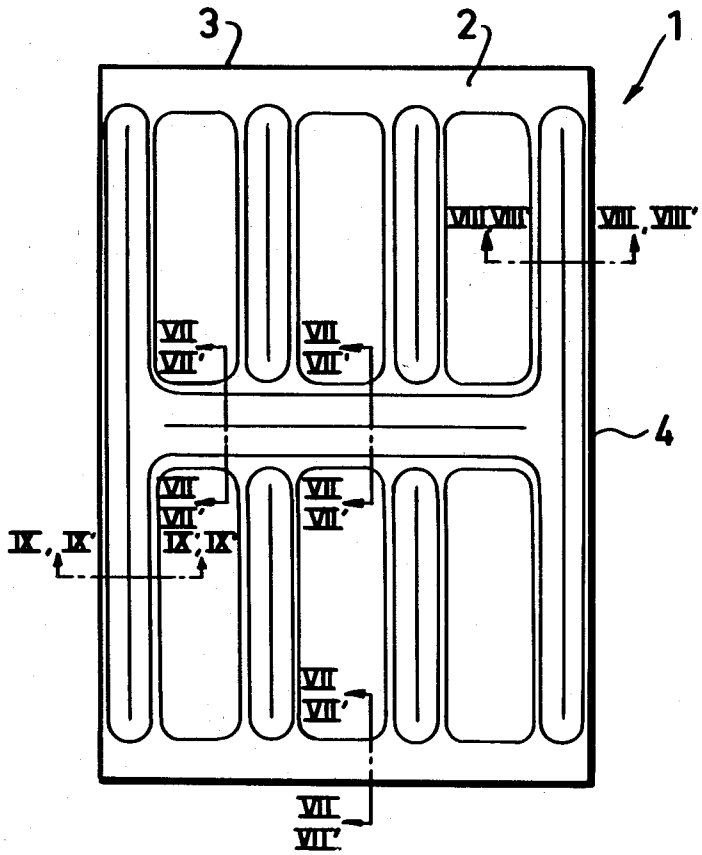
Figure 4:
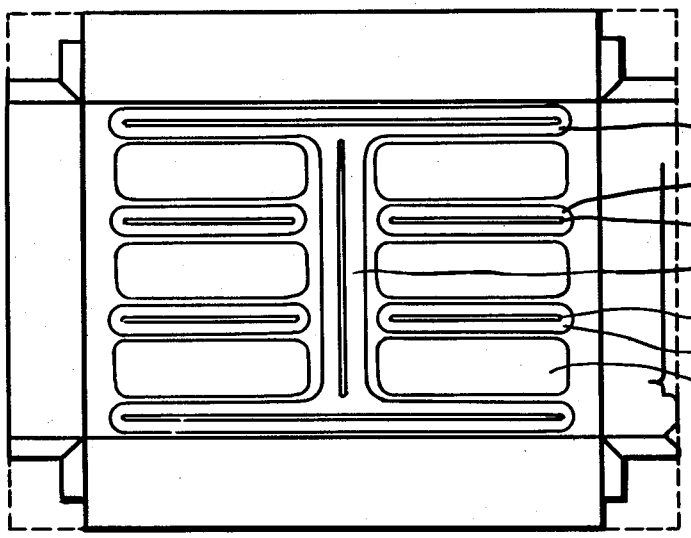
Figure 5:
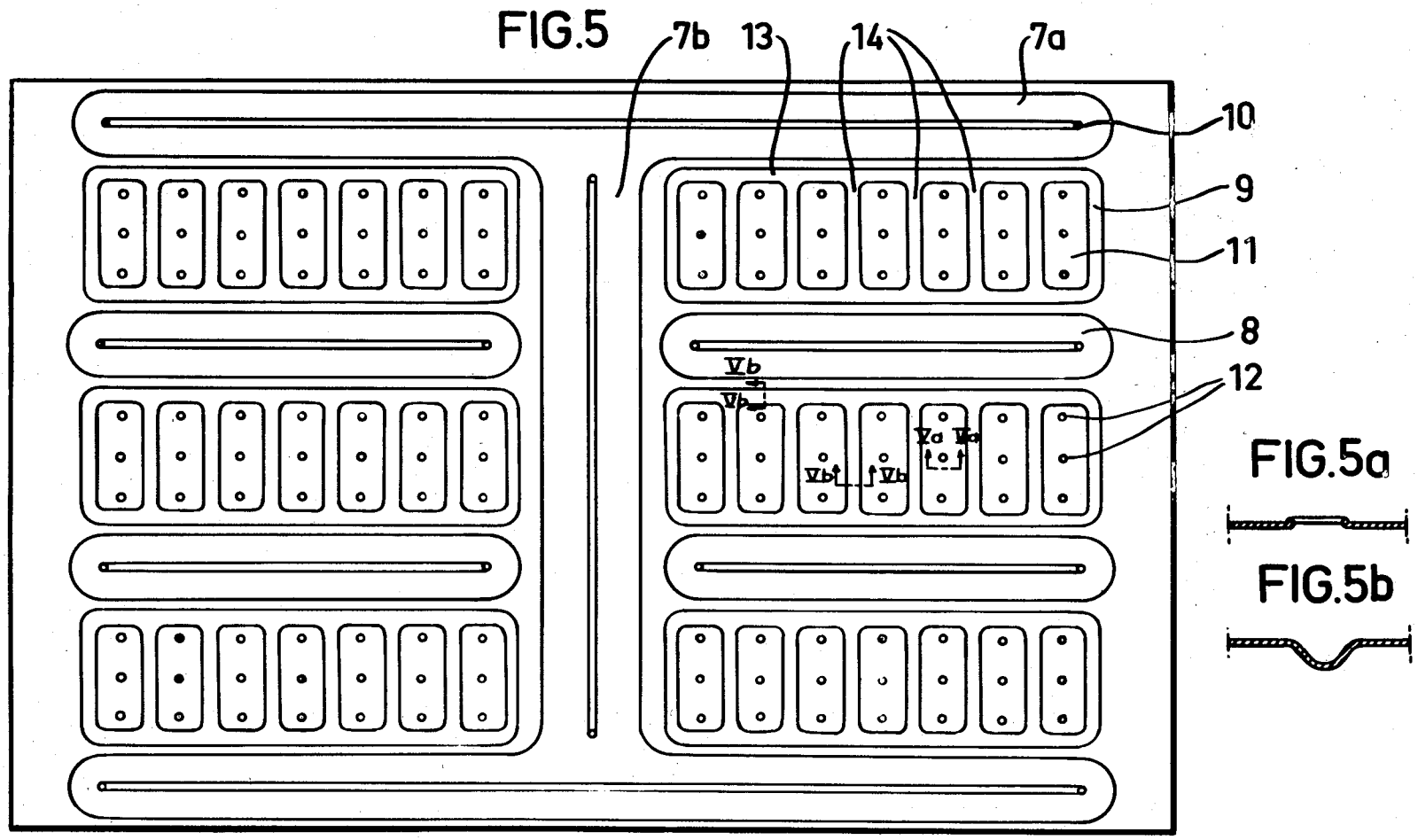
Figure 6:
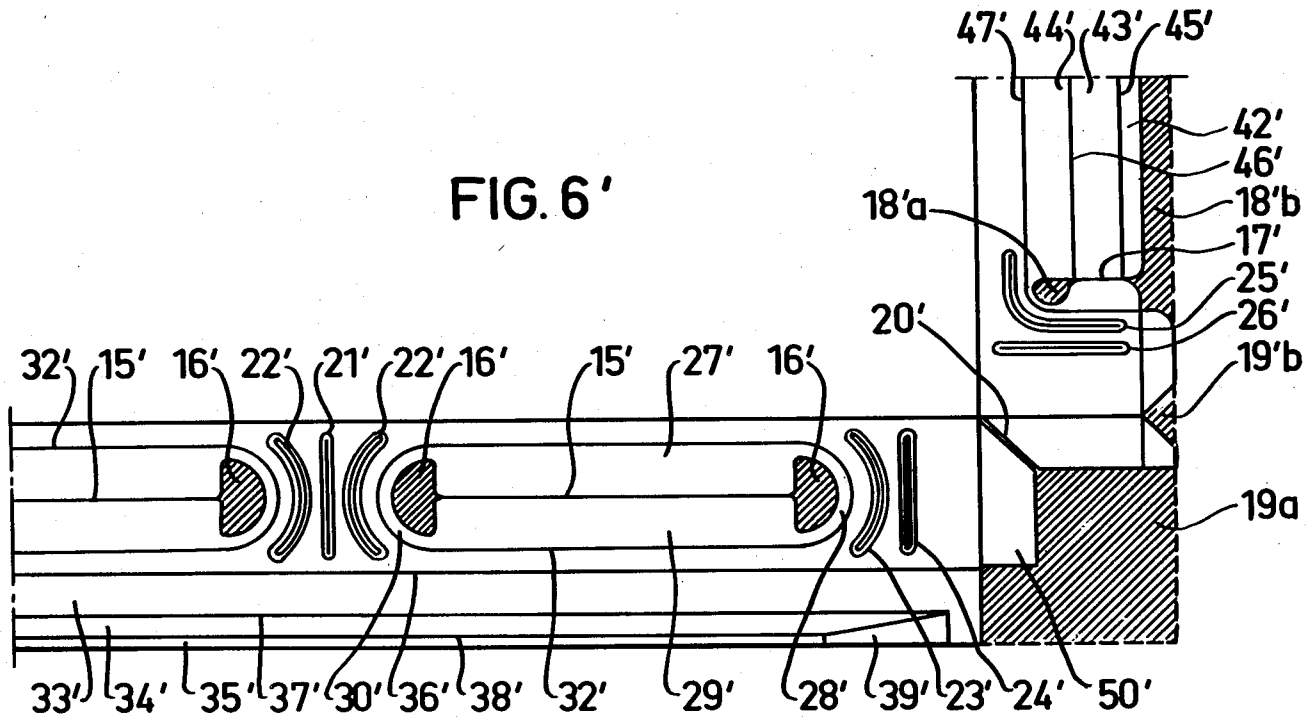
Figure 12:
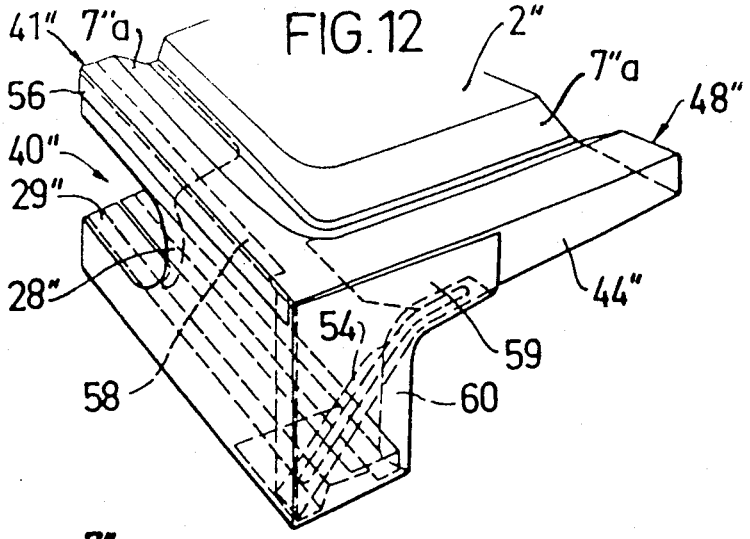
Figure 12A:
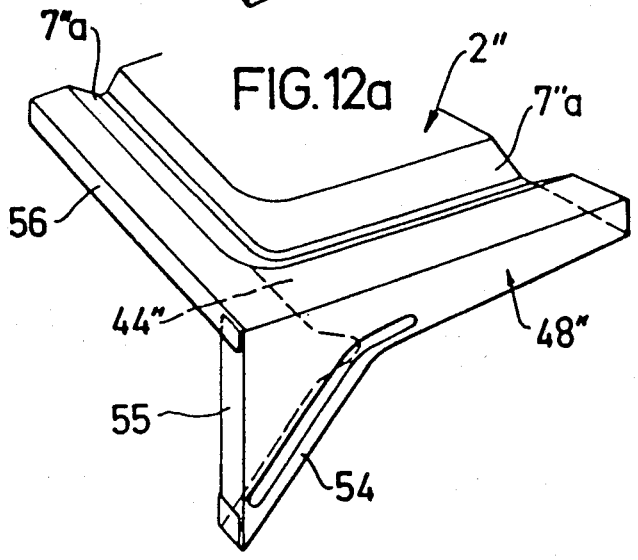
Figure 12B:
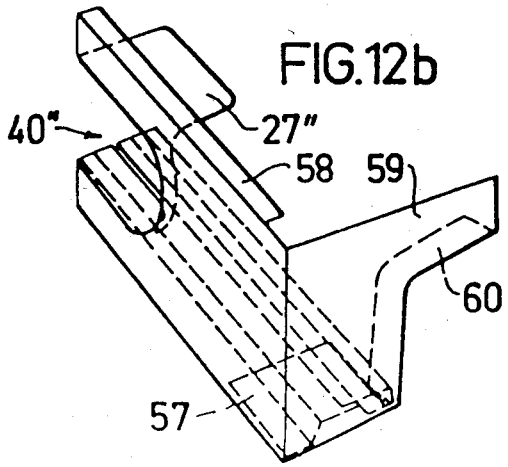

Two embodiments of the invention are described in the following, with reference to the accompanying drawings, in which FIG. 1 is a schematic horizontal view of the pallet according to the invention, FIGS. 2 and 3 are schematic lateral views of the pallet according to the invention, FIG. 4 is a schematic horizontal view of a one-piece sheet metal blank for a pallet, FIG. 5 is a horizontal view of the load-carrying plane of the pallet, FIG. 5*a* is a section after Va—Va in FIG. 5, FIG. 5*b* is a section after Vb—Vb in FIG. 5, FIGS. 6 and 6' show in detail the blank portions intended to constitute the lateral pieces of the pallet, FIGS. 7 and 7' are a section after VII—VII and, respectively, VII'—VII' in FIG. 1, FIGS. 8 and 8' are a section after VIII—VIII and, respectively, VIII'—VIII' in FIG. 1, FIGS. 9 and 9' are a section after IX—IX and, respectively, IX'—IX' in FIG. 1, FIGS. 10 and 10' show a detail of a corner of the pallet according to the invention, FIGS. 11 and 11' show a detail of the central portion of the longer lateral piece of the pallet according to the invention, and FIGS. 12, 12*a* and 12*b* show details of an alternative embodiment according to the invention.

The pallet 1 shown in FIGS. 1–3 comprises a load-carrying plane 2 and lateral pieces 3 and 4.

As appears from FIG. 1, the load-carrying plane 2 is provided with reinforcements, which will be described below in greater detail.

From FIG. 2 appears that the lateral piece 3 includes a recess 5, which renders it possible to insert lifting forks or a so-called bear beneath the load-carrying plane.

The lateral piece 4, see FIG. 3, includes two oblong openings 6, into which lifting forks can be inserted. A fork truck, thus, has accessibility to the pallet 1 from any direction.

The blank shown schematically in FIG. 4 for a pallet according to the invention comprises a load-carrying plane 2, which is reinforced in two directions perpendicular to each other.

Along the long sides of the load-carrying plane 2, two first reinforcing grooves *7a* extend, which terminate a distance from the short sides of the load-carrying plane.

The first reinforcing grooves *7a* are interconnected by a second central reinforcing groove *7b*. At the embodiment shown, the reinforcing grooves *7a* have a depth corresponding to about half the depth of the reinforcing groove *7b*.

Between the second reinforcing groove *7b* and the short sides of the load-carrying plane 2 third reinforcing grooves 8 are located, which extend in parallel with the first reinforcing grooves *7a*. The third reinforcing grooves 8 extend from the area of the second reinforcing groove *7b* to the same level as the ends of the first reinforcing grooves *7a*.

As appears from FIG. 4, the third reinforcing grooves 8 are located at a certain distance from the first reinforcing grooves *7a* and a certain distance relative to each other. Hereby a number of areas 9 are formed, which thus are located between the reinforcing grooves *7a,7b,*8 and the short sides of the load-carrying plane 2.

All of the reinforcing grooves *7a,7b,*8 are provided with holes 10 for water drainage.

As appears from FIG. 5, a number of platforms 11, at the embodiment shown seven platforms, are provided on each area 9.

The platforms 11 are provided with upward punched holes 12, whereby the upward bent edges of the hole 12, see FIG. 5*a*, result in that a good surface friction is obtained for the load-carrying plane 2.

As appears from FIG. 5*b*, the area 9 is provided with reinforcing grooves 13 and, respectively, 14, which surround the platforms 11. The reinforcing grooves 13 and 14 transform continuousla into one another and at the embodiment shown have the same depth.

The formation of the reinforcing grooves in the load-carrying plane 2 is effected by pressing, substantially stretch pressing.

Figure 6:
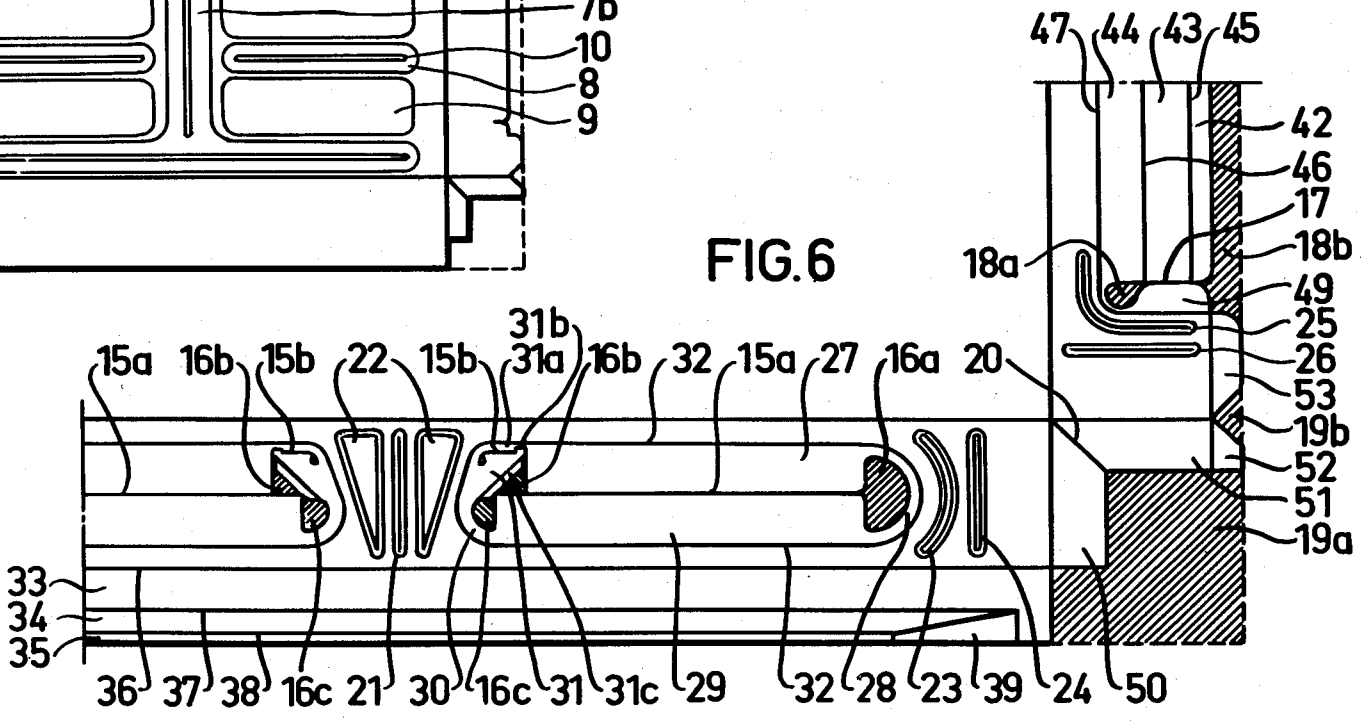

As appears from FIG. 6, the portions of the blank constituting the lateral pieces 3 and 4 are to be provided with reinforcing grooves, be folded about a number of lines and, besides, certain material is to be removed.

The formation of the openings 6, see FIG. 3, is prepared by punching cutting lines 15*a* and 15*b*. Besides, material sections 16*a,*16*b* and 16*c* are removed.

For the formation of the lateral piece 3, along the short side of the load-carrying plane 2, with the recess 5 cutting lines 17 are made on the blank. Besides, material sections 18*a* and 18*b* are removed.

In each corner of the blank the material section 19*a*, and in connection to the corner the material section 19*b* are removed. Besides, a cutting line 20 is punched.

As appears from FIG. 6, the portions of the blank intended to be the lateral pieces 3 and 4 of the pallet are provided with reinforcements in the form of impressions.

Between the portions to form the opening 6, the blank is provided with a central rectilinear impression 21, which extends across the longitudinal direction of the lateral piece 4. On both sides of this reinforcement two impressions 22 are located which have triangular shape and the base of which faces to the load-carrying plane 2.

Outside each opening 6, at the embodiment according to FIG. 6 two impressions 23 and 24 are located, of which the impression 23 located closest to the opening 6 follows the form of the opening, while the impression 24 located outside thereof is rectilinear and extends across the longitudinal direction of the lateral piece 4.

As appears from FIG. 6, also the blank portion to form the lateral piece 3 is provided with impressions 25 and 26. The impression 25 located closest to the recess 5 has a shape agreeing with that of the recess 5, while the impression 26 located outside thereof has rectilinear shape and extends across the longitudinal direction of the lateral piece 3.

As regards the folding of the blank portion to form the lateral piece 4, the openings 6 are formed in that the material sections 27,28,29,30,31 and 31*a*, which are located inside of the contour line 32 of the opening 6, are folded inward about the contour line, so that the inward folded sections substantially form a right angle with the lateral piece 4 proper. As appears from FIG. 6, there is no sharp definition between the different material sections, but they transform continuously one into the other.

From FIGS. 7–10 appears how the material sections 27, 29 and 31 are connected to other parts of the pallet. This will be dealt with in detail later on.

In order to form the lower edge beam of the lateral piece 4, the material sections 33, 34 and 35 are folded about the folding lines 36,37 and 38, respectively, The material section 39 connects the portion of the material section 33 adjoining the corner to the material section 35. From FIGS. 7–11 appears how the material sections 33,34,35 are folded. The sections 35 and 29 are connected to each other, for example by welding, whereby the edge beam 40 is formed and given sufficient stability.

As regards the material section 27, it is connected to the bottom of the groove *7a*, for example by welding, whereby an upper edge beam 41 of the lateral piece 4 is formed.

At the ends of the openings 6 facing to the impressions 32 the material sections 30,31 and 31*a* are folded inward, so that at least the section 31 substantially forms a right angle to the lateral piece 4 proper.

Figures 7, 8, 9, 10, 11:
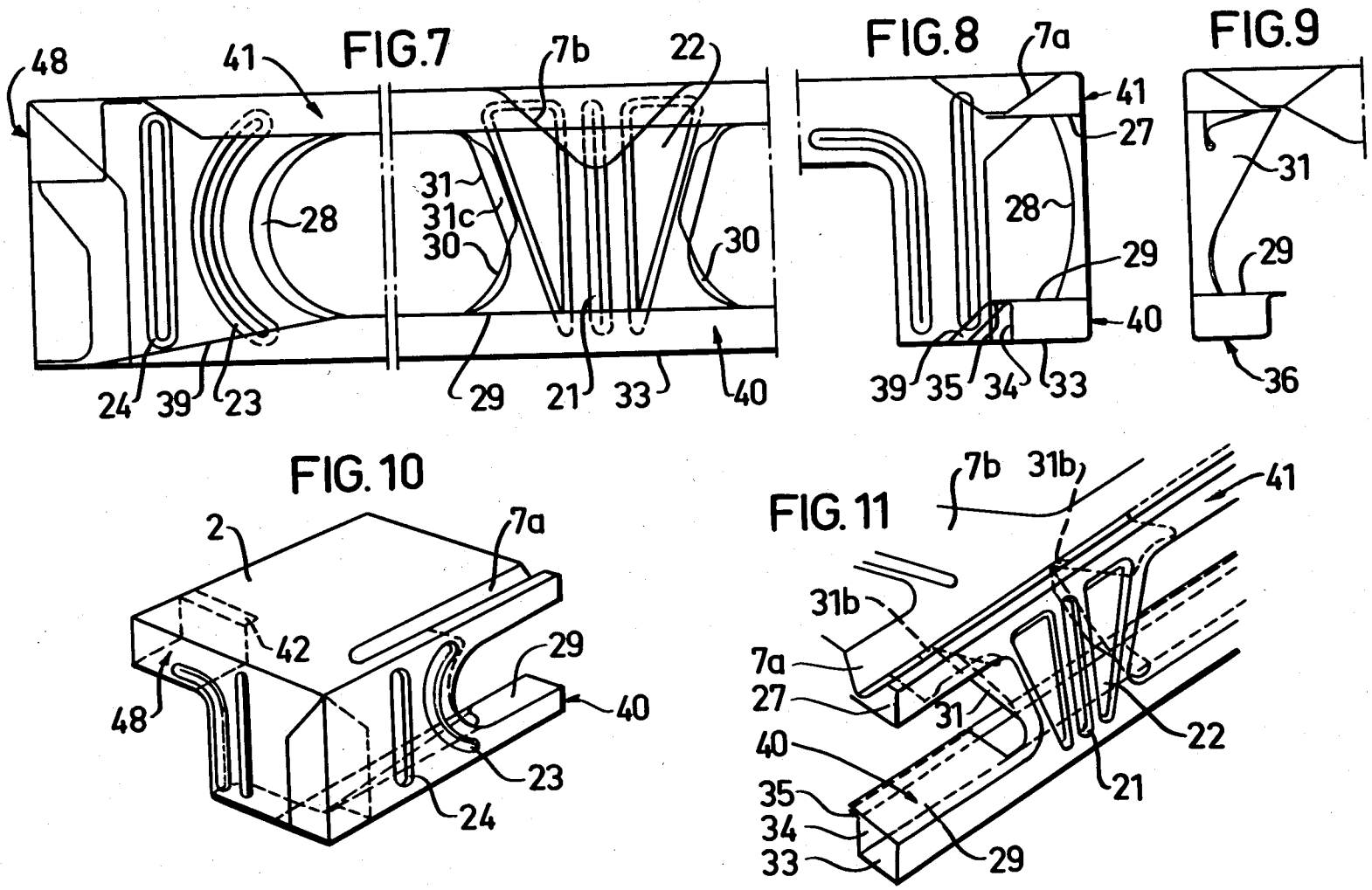
Figure 8:
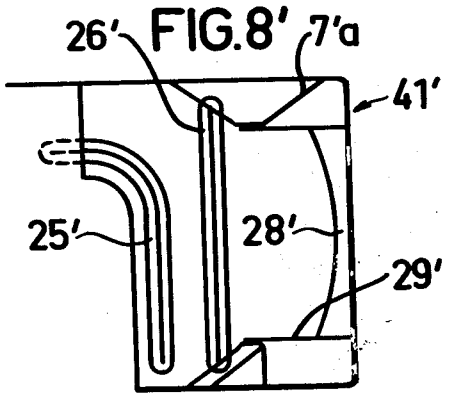
Figure 11:
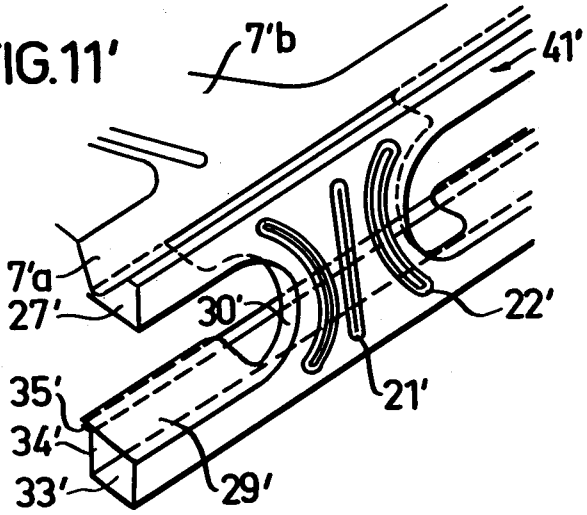
Figure 7:
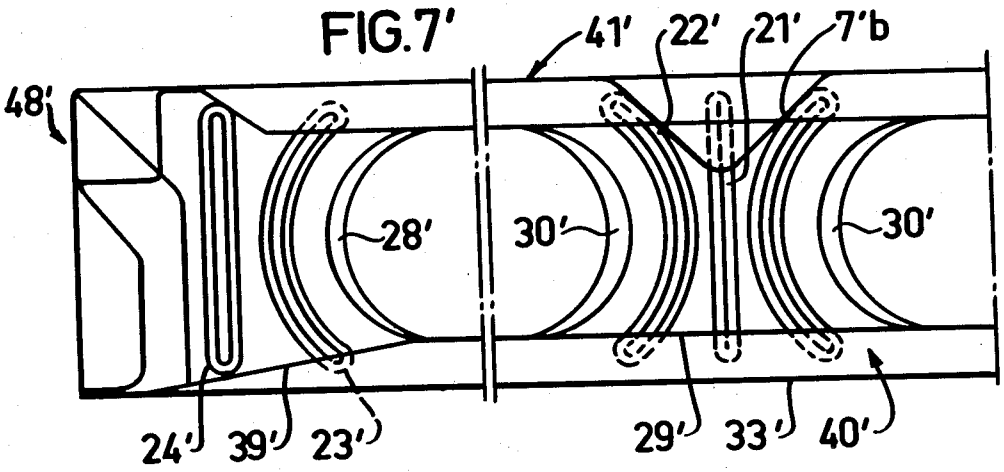
Figure 10:
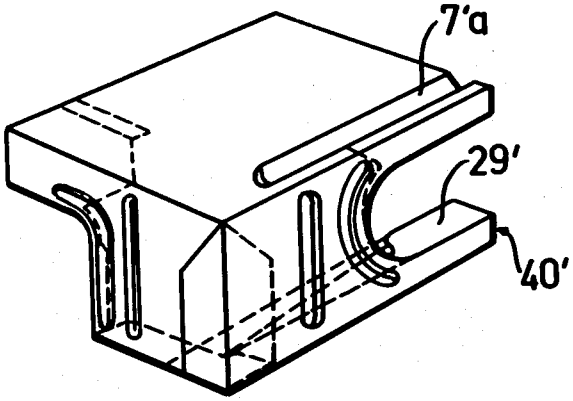
Figure 9:
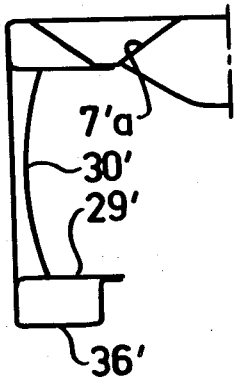

As appears from FIG. 11, a tongue 31*b* of the material section 31 is folded relative to said material section and connected to the bottom of the groove *7a*, for example by welding. A flap 31*c* is folded relative to the section 31 proper, see FIG. 7, in order to reinforce the free edge of the section 31.

The material section 28 is bent inward to an angle of substantially 45° to the lateral piece 4 proper.

In order to form the recess 5 of the lateral piece 3, the material sections 42,43 and 44 are folded about the folding lines 45,46 and 47, respectively. From FIG. 10 appears how the folding takes place. The material section 42 is connected, for example by welding, to the lower side of the load-carrying plane 2, whereby a box beam 48 is formed.

The material sections 49 are folded inward to a substantially right angle to the lateral piece 3 proper, whereby the lateral edges of the recess 5 are reinforced.

The corner between the lateral pieces 3 and 4 is formed in that the material section 50 in each corner is folded inward and connected to the lateral piece 3 on the outside thereof, and the material section 51 in each corner also is folded inward and connected to the lateral piece 4 on the inside thereof, see FIG. 10. The material sections 52 and 53 in each corner are folded inward, whereby the section 52 is connected to the inward folded material section 33 on the upper side thereof. The aforesaid connections preferably are made by welding.

The embodiment shown in FIGS. 6'–11' differ from the embodiment described above in that the edges of the openings 6 are reinforced in a corresponding manner in the area of their ends. The blank for the pallet, see FIG. 6', in each portion to form the lateral piece 4 is provided with only one cutting line 15'. Where the cutting line 15' terminates, the material sections 16' are removed.

In a corresponding manner as at the embodiment described above, the material sections 27' and 20' are connected, for example by welding, to other parts of the pallet.

The material sections 28' and 30' are folded only inward, substantially to an angle of 45° to the lateral piece 4 proper.

The reinforcements located between the openings 6 partially have a different design than at the first embodiment. The central impression 21' has not been altered. As regards the impressions 22' located on both sides of this impression 21', they have been given a design agreeing with that of the impressions 23 and 23', i.e. they follow the shape of the openings 6.

The lateral piece 3 is formed in a way corresponding to the embodiment described above.

The pallet according to the invention is made of sheet metal, and the ductility and load-carrying properties of the material have been utilized at optimum.

At the embodiments shown the load-carrying plane 2 proper is reinforced in two directions perpendicular to each other. The reinforcement of the load-carrying plane 2 takes place gradually, starting through the small reinforcing grooves 14 all the way up to the central reinforcing groove 7*b*. It is, of course, possible within the scope of the invention to form alternative reinforcing configurations for the load-carrying plane. It is, for example, imaginable that there are only diagonally extending or circular reinforcing grooves in the load-carrying plane 2. Also other configurations of the reinforcement, which in an acceptable way take down the loads to the lateral pieces, of course, can be imagined for the load-carrying plane.

The reinforcing groove 7*a* has a greater depth than the reinforcing grooves 7*b*. For rendering it possible to insert the fork beneath the load-carrying plane as smoothly as possible, the lower side of the edge beams 48;48' are on the same level as the lowermost point of the reinforcing groove 7*b*. In a corresponding way, the lower side of the edge beams 41;41' is on the same level as the lowermost point of the reinforcing grooves 7*a*.

The lateral pieces 3 and 4, thus, are provided with reinforcing edge beams 48;48' and, respectively, 40, 41;40',41'. As regards the lateral piece 4, the entire piece by itself acts as a beam. This is of great importance for the carrying capacity of the pallet, i.e. that the material can be utilized as effectively as possible. In order to prevent the material in the lateral pieces 3 and 4 from buckling, they are provided with reinforcements in the form of impressions 21–26;21'–26', which prevent buckling in the portions of the lateral pieces which are subjected to compressive stresses. Due to the fact that certain impressions, 23,23' and 25,25', follow the contour of the holes 6 or recesses 5, the risk additionally decreases that buckling will occur in the lateral pieces 3 and 4.

According to a further embodiment of the pallet according to the present invention, see FIGS. 12, 12*a* and 12*b*, the pallet according to the invention can be manufactured of three partial elements. This embodiment, besides, differs from the one described above by the configuration of the load-carrying plane and the structural design of the corners of the pallets.

As appears from FIG. 12*a*, the load-carrying plane 2'' comprises a reinforcing groove 7''*a* extending along the entire periphery with a varying depth. The depth of the groove 7''*a* is substantially smaller along the long side of the pallet than along the short side thereof. The reason of this is that at the bending inward of the material section 44'' this section can be attached directly, for example by welding. to the bottom of the deeper part of the groove 7''*a*. Hereby additional bending of said material section is avoided, which is necessary at the embodiments described above.

From FIG. 12*a* further appears that the blank shown therein so is bent in the area of the pallet corners, that a diagonally extending reinforcing portion 54 is formed, which is made in one piece with the material section 44''. This portion 54 constitutes a material section bent from the short side of the pallet. The blank according to FIG. 12*a* includes in the area for the corner a further material section 55 bent from the short side of the pallet, which section after bending at right angle lies in the same plane as the long side of the pallet.

As appears from FIG. 12*a*, the blank also includes a connecting edge 56, which is bent downward at a right angle from the load-carrying plane 2'' and, for example by welding, will be joined with the blank according to FIG. 12*b*.

The blank shown in FIG. 12*b* comprises substantially a long side of the pallet with connecting portions 60 to the short sides of the blank according to FIG. 12*a*.

When distinguishes the blank according to FIG. 12*b* from corresponding portions of the one-piece pallets described above, is primarily that the edge beam 40'' abutting the support comprises much more material and thereby is stronger.

The edge beam 40'' is wider than corresponding edge beams at the embodiments described above. The edge beam 40'', besides, has two surfaces abutting the support. In the area for the corner a portion 57 bent from the lateral piece of the short side is connected from below to the edge beam 40''.

The blank according to FIG. 12*b* comprises also a connecting edge 58, which is bent inward at a right angle along the long side of the pallet at the upper edge of the lateral piece and which, for example by welding, will be joined to the blank according to FIG. 12*a*.

From the upper edge of the openings along the long sides of the pallet a material section 27'' is bent inward.

The portions 59 of the blank according to FIG. 10''*b* which will be comprised in the short side of the pallet, comprise an inward bent reinforcing and connecting portion 60.

For forming the pallet according to FIG. 12, the blank according to FIG. 12*a* is combined with two blanks according to FIG. 12*b* in accordance with what is shown in FIG. 12. Thereby the corner of the blank according to FIG. 12*a* will be located within the corner of the blank according to FIG. 12*b*, whereby the three blanks are connected, preferably by spot welding in suitable placed.

The material section 27'' is connected from below to the bottom of the groove 7''*a*.

From FIG. 12 appears that the material section 54 forms a reinforcing diagonal in the corner of the completed pallet.

The invention is not restricted to the embodiments described above, but can freely be varied within the scope of the attached claims.

We claim:

1. A pallet made of folded sheet metal comprising a substantially planar and rectangular load-carrying sheet provided with reinforcing grooves and lateral edge pieces folded down from said sheet on all four sides thereof, wherein each edge piece is cut and folded inwardly on itself to form an opening for a pallet lifting means and a box-section reinforcement beam bounding the opening at least on one side of the opening whereby the pallet is accessible from all sides for lifting means inserted beneath the load-carrying sheet.

2. A pallet as defined in claim 1 wherein the lateral pieces are rigidly interconnected together at respective corners of the sheet.

3. A pallet as defined in claim 1 wherein at least two opposed box-section beams are formed adjacent a reinforcing groove in an edge of the load-carrying sheet.

4. A pallet as defined in claim 1 including reinforcing grooves in the load-carrying sheet which have a depth conforming to the height of at least certain of the box-section beams.

5. A pallet as defined in claim 1 wherein a pair of opposite lateral pieces each have cut and folded sections which define an upper box-section beam adjacent said sheet and a lower box-section beam defining a lower edge of the pallet, said upper and lower box-section beams defining one of said openings therebetween.

6. A pallet as defined in claim 5 wherein another pair of opposite lateral pieces each have cut and folded sections which define an upper box-section beam adjacent said sheet with an open recess thereunder defining one of said openings and feet at opposite ends of the recess defining the lower edge of the pallet.

7. A pallet as defined in claim 1 wherein the lateral pieces have impressions located adjacent the openings.

8. A pallet as defined in claim 1 including an inwardly bent reinforcing portion in each corner of the pallet which extends diagonally in the respective corner.

9. A pallet as defined in claim 8 wherein the reinforcing portion is integral with one of the lateral pieces constituting an adjacent side of the pallet.

10. A pallet as defined in claim 8 having a reinforcing groove extending along the entire circumference of the load-carrying sheet, said groove having a greater depth along shorter sides of the pallet than along the longer sides of the pallet.

* * * * *